US007658316B2

(12) United States Patent
Kawashita

(10) Patent No.: US 7,658,316 B2
(45) Date of Patent: Feb. 9, 2010

(54) PACKING CONTAINER AND ASSEMBLING METHOD THEREOF

(75) Inventor: Hiroshi Kawashita, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/272,544

(22) Filed: Nov. 17, 2008

(65) Prior Publication Data

US 2009/0321505 A1 Dec. 31, 2009

(30) Foreign Application Priority Data

Jun. 27, 2008 (JP) ..... 2008-168787

(51) Int. Cl.
*B65D 23/04* (2006.01)
*B65D 5/491* (2006.01)

(52) U.S. Cl. ..... 229/120.33; 229/120.29; 229/120.34

(58) Field of Classification Search ..... 229/120.24, 229/120.26, 120.28, 120.29, 120.33, 120.34, 229/120.37
See application file for complete search history.

(56) References Cited

U.S. PATENT DOCUMENTS 588,423 A * 8/1897 Guilbert ..... 229/120.34
2,015,283 A * 9/1935 Pashley et al. ..... 229/120.37
2,663,490 A * 12/1953 Etra et al. ..... 229/120.04
2,823,845 A * 2/1958 Wasyluka ..... 229/120.34
2,904,382 A * 9/1959 Mitten ..... 229/120.02
3,749,299 A * 7/1973 Ingle ..... 229/120.34
4,108,349 A * 8/1978 Pfaffendorf ..... 229/120.26
4,463,997 A * 8/1984 Densen ..... 229/120.34
4,938,415 A * 7/1990 Walker et al. ..... 229/120.33
5,143,431 A * 9/1992 Udell ..... 229/120.24

FOREIGN PATENT DOCUMENTS

| | | |
|---|---|---|
| JP | 55 3971 | 1/1980 |
| JP | U 7-028888 | 5/1995 |
| JP | A 9-142447 | 6/1997 |
| JP | 2001-341730 | 12/2001 |
| JP | A 2004-001806 | 1/2004 |
| JP | A 2005-219774 | 8/2005 |

* cited by examiner

*Primary Examiner*—Gary E Elkins
(74) *Attorney, Agent, or Firm*—Patterson & Sheridan, LLP

(57) ABSTRACT

A packing container includes: an outer case; a partition member disposed inside the outer case; and a pair of holding plates connected to upper edges of a pair of side plates of the outer case and inserted into the inside of the outer case, the pair of holding plates holding the partition member.

9 Claims, 19 Drawing Sheets

PACKING CONTAINER AND ASSEMBLING METHOD THEREOF

CROSS-REFERENCE TO THE INVENTION

This application is based upon and claims the benefit of priority from the prior Japanese Patent Application No. 2008-168787, filed on Jun. 27, 2008; the entire contents of which are incorporated herein by reference.

BACKGROUND OF THE INVENTION

1. Field of the Invention

The present invention relates to a packing container for packing products and to a composing method thereof.

2. Description of the Related Art

Various kinds of products (for example, electric products) are transported with being packed in a packing container of paper or the like. For example, a component housing carton which houses electric components or the like is disclosed (see JP-A 9-142447 (KOKAI)).

SUMMARY OF THE INVENTION

Here, in a case that a plurality of products is disposed in a packing container, there occurs a need to divide spaces between those products by a partition plate of the like. In consideration that the packing container leans during transportation, it is preferable that the partition plate disposed in the packing container is held in relation to the packing container. However, since it becomes necessary to fix the partition plate disposed in the packing container, a structure of the packing container tends to become complicated.

An object of the present invention is to provide a packing container with a simple structure in which spaces between a plurality of products can be divided, and a composing method thereof.

A packing container according to an aspect of the present invention includes: an outer case having an almost rectangular bottom plate, first to fourth side plates sequentially disposed in correspondence with edges of the bottom plates respectively, and a first opening of an almost rectangular shape facing the bottom plate, a partition member disposed inside the outer case, the partition member having fifth and sixth side plates disposed in close vicinity to or in contact with the first and third side plates respectively, seventh and eight side plates at least one of which divides the inside of the outer case, and a second opening disposed in correspondence with the first opening; a first holding plate connected to an upper edge of the first side plate and inserted into the inside of the outer case from the first opening, the holding plate holding the partition member; and a second holding plate connected to an upper edge of the third side plate and inserted into the inside of the outer case from the first opening, the second holding plate holding the partition member.

An assembling method of a packing container according to an aspect of the present invention includes: inserting a partition member into the inside of an outer case; and holding the partition member with first and second holding plates, wherein the outer case has an almost rectangular bottom plate, first to fourth side plates sequentially disposed in correspondence with edges of the bottom plates respectively, and a first opening of an almost rectangular shape facing the bottom plate, wherein the partition member has fifth to eighth side plates and a second opening, wherein the first and second holding plates are connected to upper edges of the first and third side plates respectively, wherein, in the inserting, the fifth and sixth side plates are disposed in close vicinity to or in contact with the first and the third side plates respectively, at least either one of the seventh and eight side plates divides the inside of the outer case, and the second opening is disposed in correspondence with the first opening, and wherein, in the holding, the first and second holding plates are inserted into the inside of the outer case from the first opening.

DESCRIPTION OF THE EMBODIMENTS

Hereinafter, embodiments of the present invention will be described in detail with reference to the drawings.

First Embodiment

Figure 1:
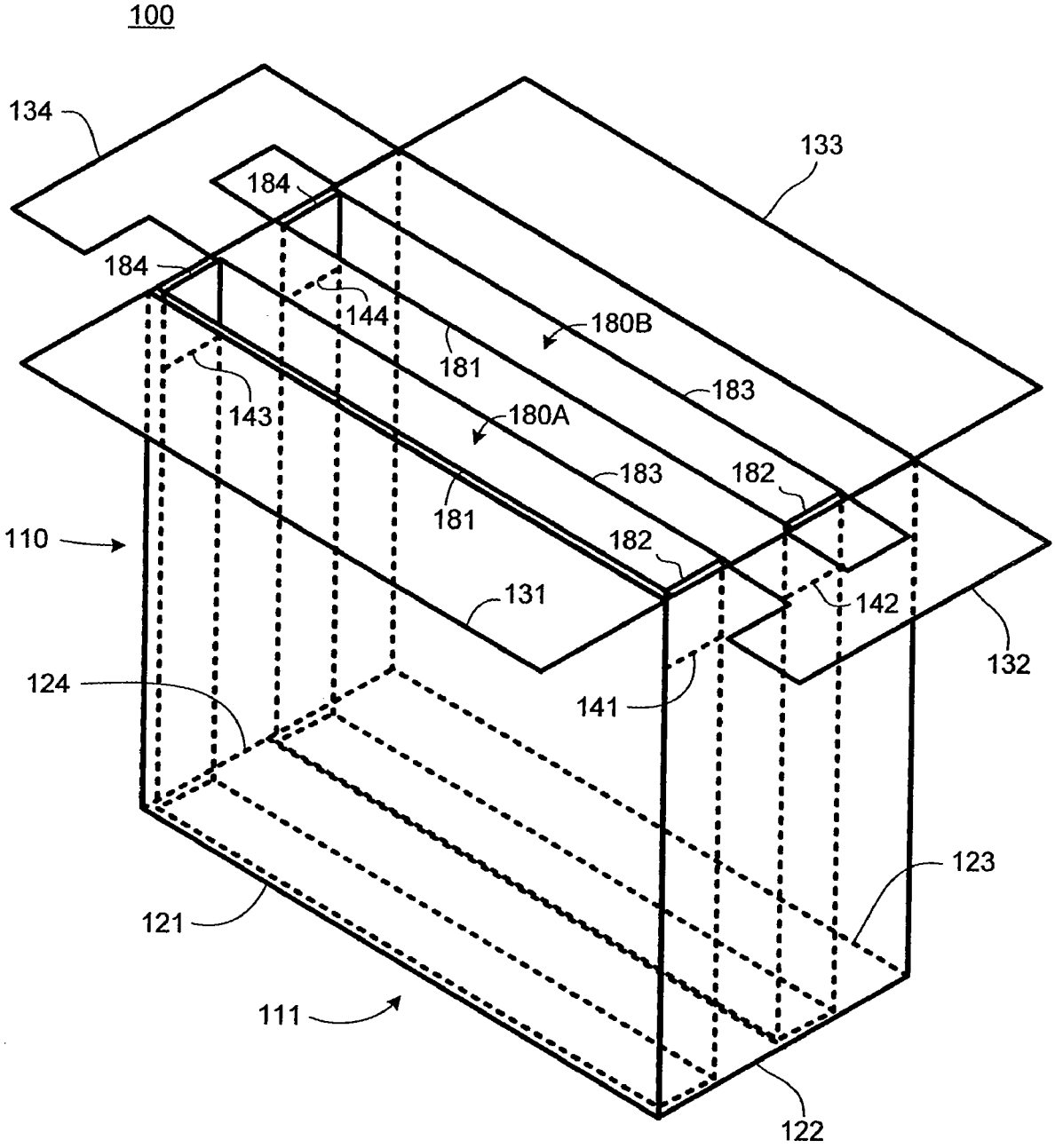
FIG. 1 is a perspective view showing a packing container 100 according to a first embodiment of the present invention.

FIG. 1 is a perspective view showing a packing container 100 according to a first embodiment of the present invention.

Figure 2:
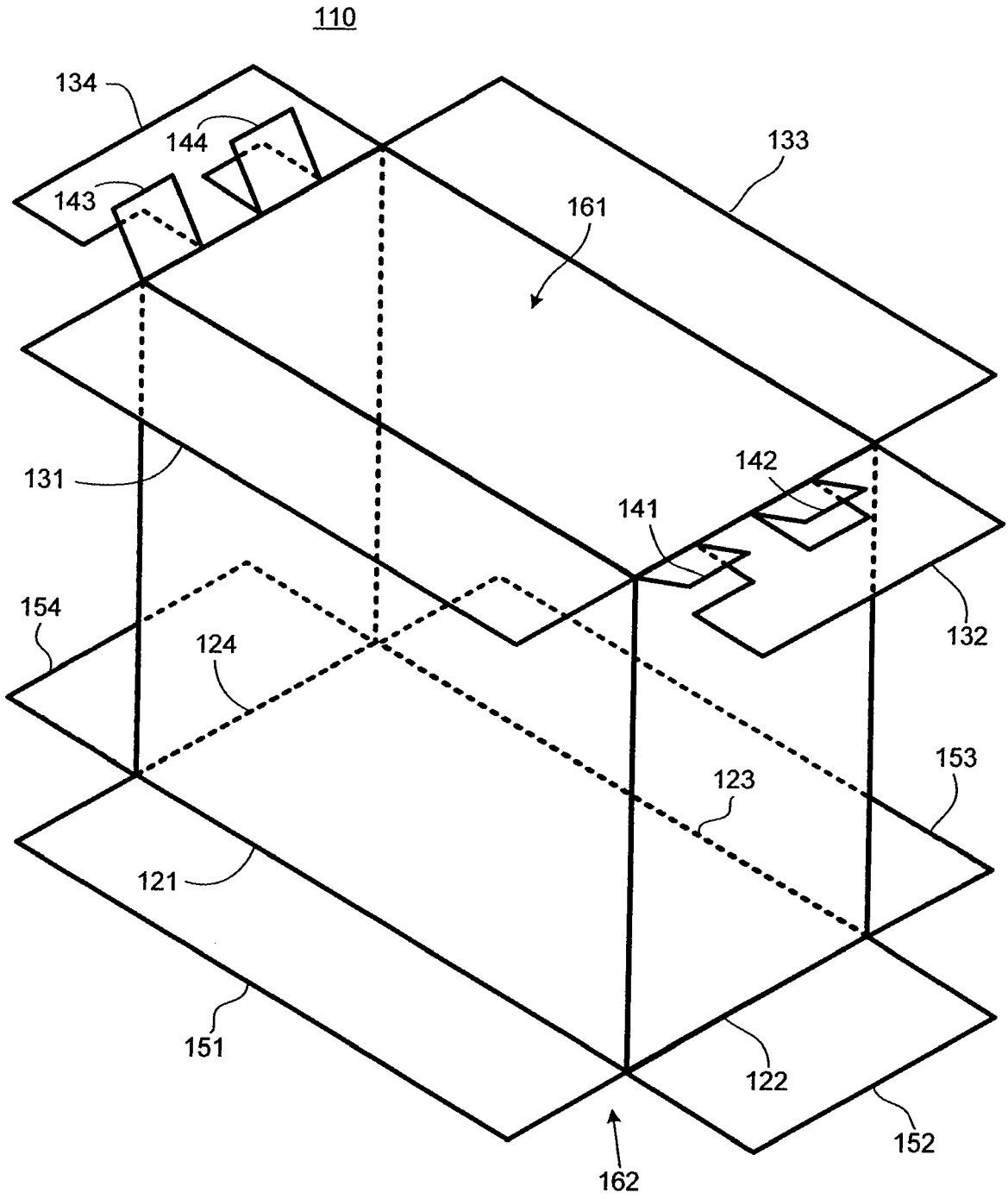
FIG. 2 is a perspective view showing an outer case 110 in a developed state.
Figure 3:
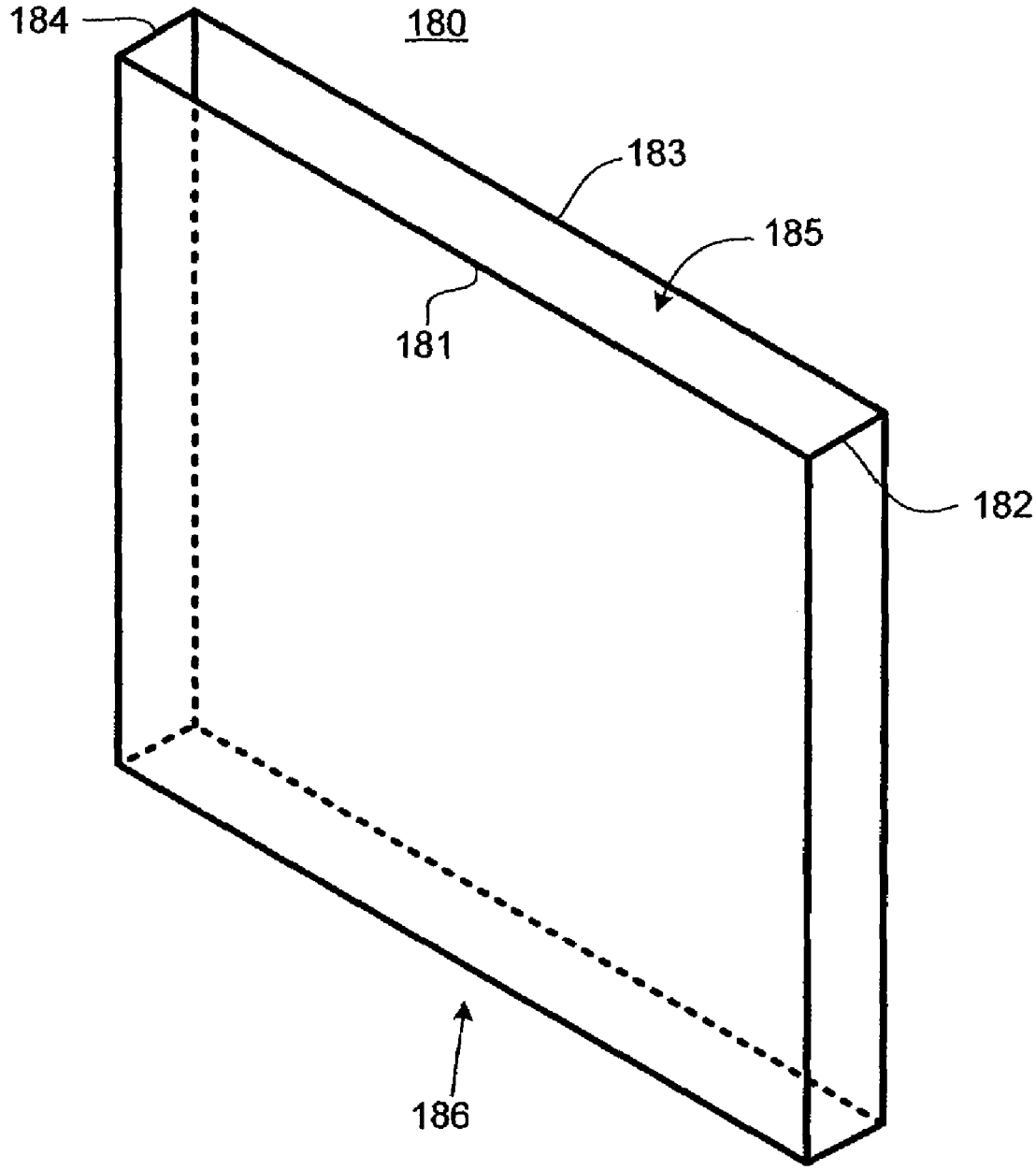
FIG. 3 is a perspective view showing a partition member 180.

The packing container 100 includes an outer case 100 and a partition member 180 (180A, 180B). FIG. 2 and FIG. 3 are perspective views showing the outer case 110 and the partition member 180 respectively. FIG. 2 shows a state that the outer case 110 is developed.

The outer case 110 is structured by, for example, paper such as corrugated cardboard, and has a bottom plate 111, side plates 121 to 124, upper cover plates 131 to 134, and holding plates 141 to 144.

The bottom plate 111 is almost rectangular. As shown in FIG. 2, the outer case 110 has bottom cover plates 151 to 154. The bottom plate 111 is constituted by closing the bottom cover plates 151, 153 and sealing a space therebetween with an adhesive tape (for example, a tape for packing) as necessary. It should be noted that the bottom cover plates 151 to 154 are omitted to be shown in FIG. 1 for the sake of comprehensibility.

The side plates 121 to 124 are almost rectangular and are sequentially disposed in correspondence with edges of the bottom plate 111. The outer case 110 has an opening 161 whose boundary is defined by upper edges of the side plates 121 to 124, and from this opening 161, the partition member 180, a product (an electric product or a member for an electric product) or the like can be fed into the outer case 110.

The upper cover plates 131 to 134 are almost rectangular and are connected to the upper edges of the side plates 121 to 124 respectively, and can be opened/closed with those upper edges being axes (so-called flaps). The opening 161 can be closed by handling the upper cover plates 131, 133. The holding plates 141 to 144 are disposed in the upper cover plates 132, 134. Those holding plates 141 to 144 can be formed by cutting out the upper cover plates 132, 134. The holding plates 141 to 144 are inserted into the partition member 180 and hold the partition member 180. Details thereof will be described later.

The partition member 180 is structured by, for example, paper such as corrugated cardboard, and has almost rectangular side plates 181 to 184 (so-called sleeve shape). Upper and lower sides of the partition member 180 are open (the partition member 180 has openings 185, 186). As shown in FIG. 1, the partition member 180 is disposed in the outer case 110 in a manner that those side plates 181 to 184 correspond to the side plates 121 to 124 of the outer case 110. The side plates 181, 183 divide the inside of the outer case 110, so that it becomes easy to dispose a plurality of products in the packing container 100.

In this embodiment, the inside of the outer case 110 is divided into four by the partition members 180A, 180B. In other words, in the present embodiment, the side plate 181 of the partition member 180A is in close vicinity to or in contact with the side plate 121 of the outer case 110, not playing a role to divide the packing container 100. However, it is possible to further divide the outer case 110 by the side plate 181 of the partition member 180A, by making widths of the side plates 122, 124 of the outer case 110 larger. In such a case, the inside of the outer case 110 is divided into five. On the other hand, it is also possible to make the side plate 183 of the partition member 180B be in close vicinity to or in contact with the side plate 123 of the outer case 110 by making the widths of the side plates 122, 124 of the outer case 110 smaller. In such a case, the inside of the outer case 110 is divided into three.

The side plates 182, 184 are in close vicinity to or in contact with the side plates 122, 124, inside the outer case 110. The holding plates 141, 142 correspond to the respective side plates 182 of the partition members 180A, 180B. The holding plates 143, 144 correspond to the respective side plates 184 of the partition members 180A, 180B. As a result that the holding plates 141 to 144 are inserted into the partition members 180A, 180B, displacement of the partition members 180A, 180B is restrained. In other words, the holding plates 141 to 144 function as holding plates to hold partition members.

It is preferable that the side plates 182, 184 of the partition members 180 and the holing plates 141 to 144 are secured. For example, it is possible to secure the side plates 182, 184 and the holding plates 141 to 144 with adhesive tapes. It is also possible to secure the side plates 182, 184 and the holding plates 141 to 144 by making slits in the side plates 182, 184 and inserting end portions of the holding plates 141 to 144 thereinto. In such a case, it is preferable that the end portions of the holding plates 141 to 144 have taper shapes (for example, triangular shapes, trapezoid shapes).

Figure 4:
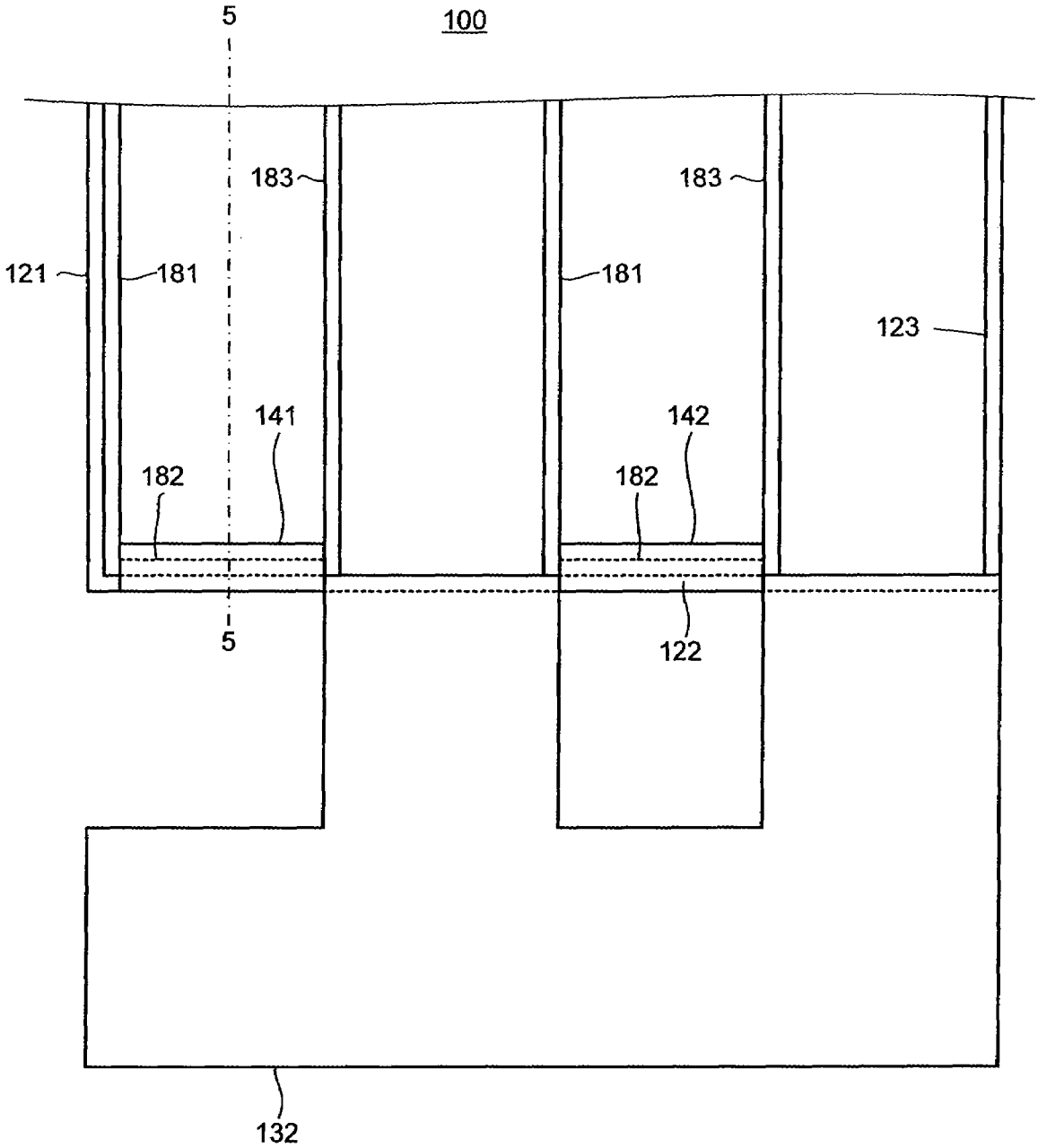
FIG. 4 is an enlarged upper surface view showing part of the packing container 100.
Figure 5:
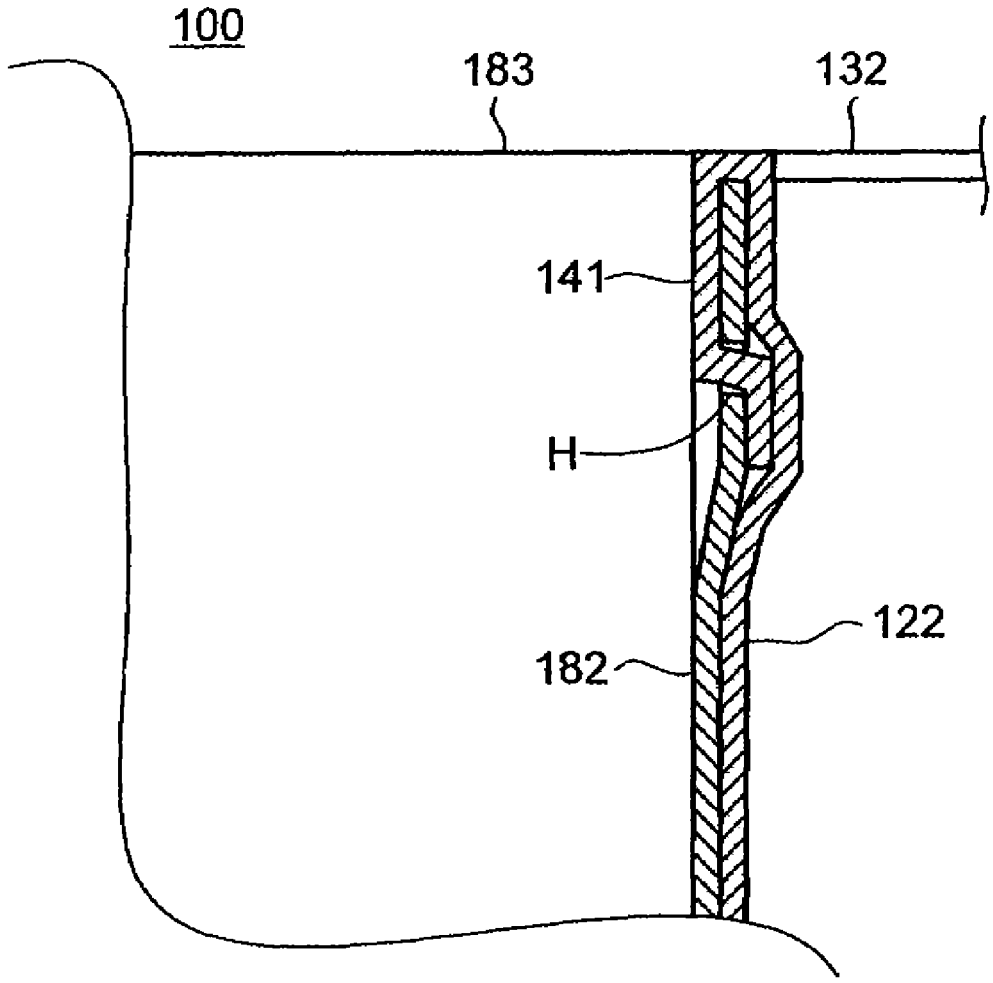
FIG. 5 is an enraged cross-sectional view showing a state that the packing container 100 is sectioned.

FIG. 4 is an enlarged upper surface view showing a state that part of the packing container 100 is magnified. FIG. 5 is an enraged cross-sectional view showing a state that the packing container 100 is sectioned along a line 5-5 of FIG. 4. The holding plate 141 is inserted into the inside of the partition member 180A and the end portion of the holding plate 141 is inserted into a slit H provided in the side plate 182.

Figure 6:
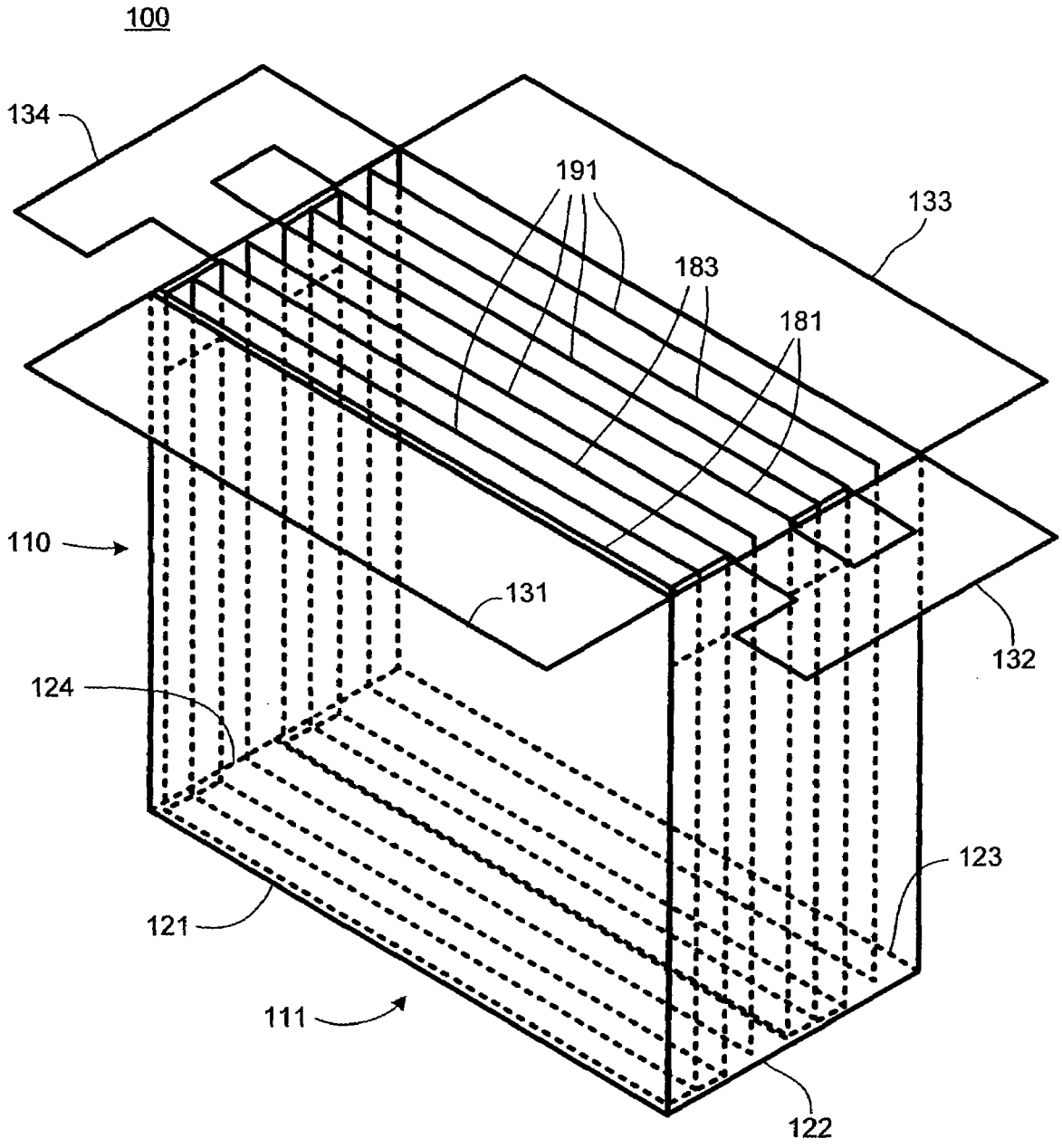
FIG. 6 is a perspective view showing a state that a partition plate 191 is inserted into the packing container 100.
Figure 7:
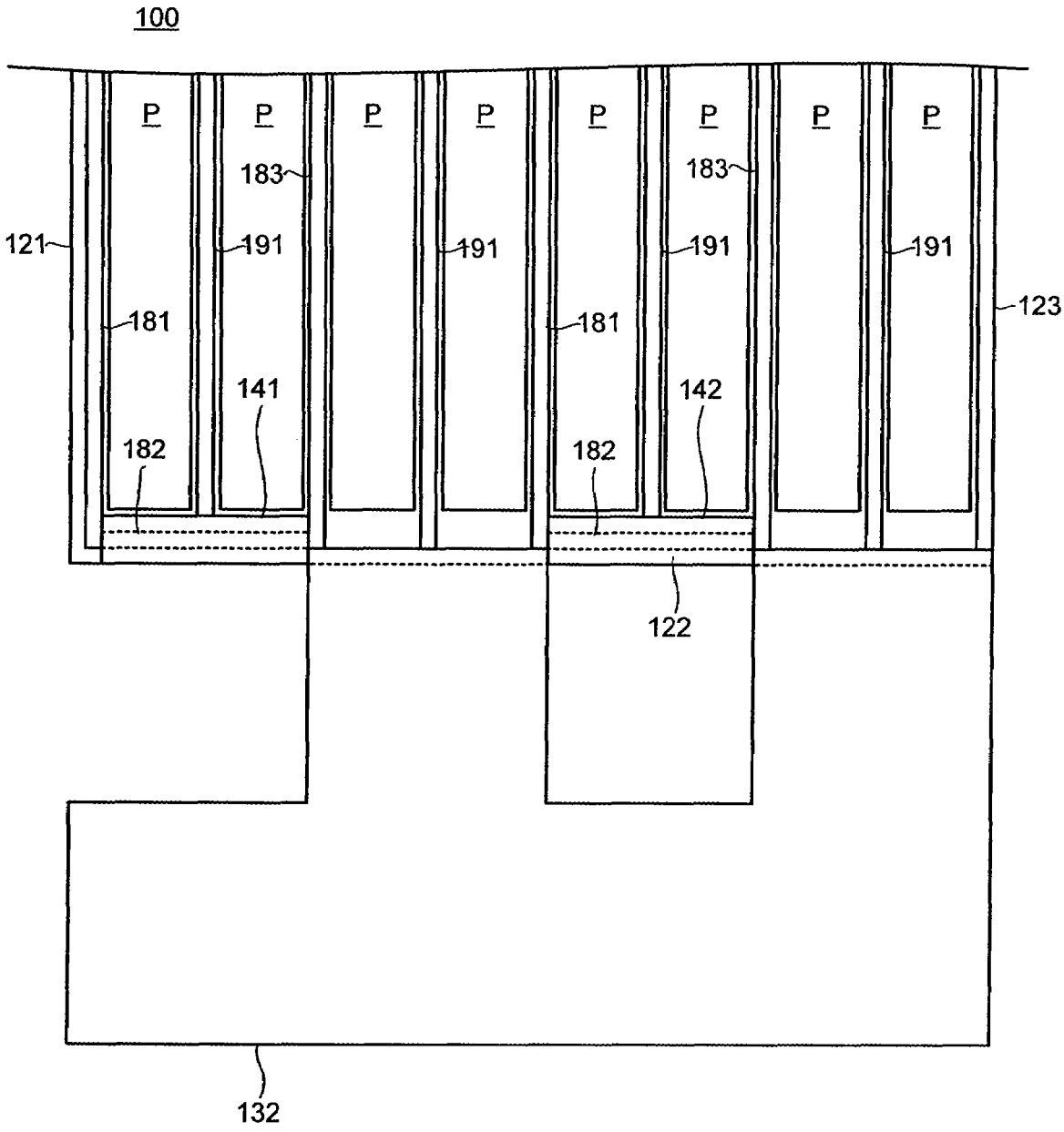
FIG. 7 is an enlarged upper surface view showing a state that a product and the partition plate 191 are inserted into the packing container 100.

Here, a partition plate can be inserted into the inside of the outer case 110. FIG. 6 is a perspective view showing a state that four partition plates 191 are inserted into the packing container 100. FIG. 7 is an enlarged upper surface view showing a state that part of an upper surface of the packing container 100 at such a time is magnified. In FIG. 7, products P as objects to be packed are disposed inside the packing container 100.

The partition plate 191 is almost rectangular and is structured by, for example, paper such as corrugated cardboard. As a result that the partition plates 191 are disposed inside and outside the partition members 180A, 180B, the inside of the outer case 110 is divided into eight, so that eight products P are disposed inside the outer case 110. It should be noted that the number of the partition plate 191 can be altered accordingly. For example, three or more partition plates 191 can be disposed inside or outside the partition members 180A, 180B to increase the number of the products P to be disposed in the outer case 110.

Here, the partition plate 191 is not fixed to the outer case 110 or the partition members 180A, 180B. However, it is also possible to fix the partition plate 191 by a given means (for example, adhesive tape).

It is preferable that the products P having widths of almost one half widths of the partition members 180A, 180B are packed, in decreasing jiggling of the product P in the packing container 100.

COMPARATIVE EXAMPLE

Figure 8:
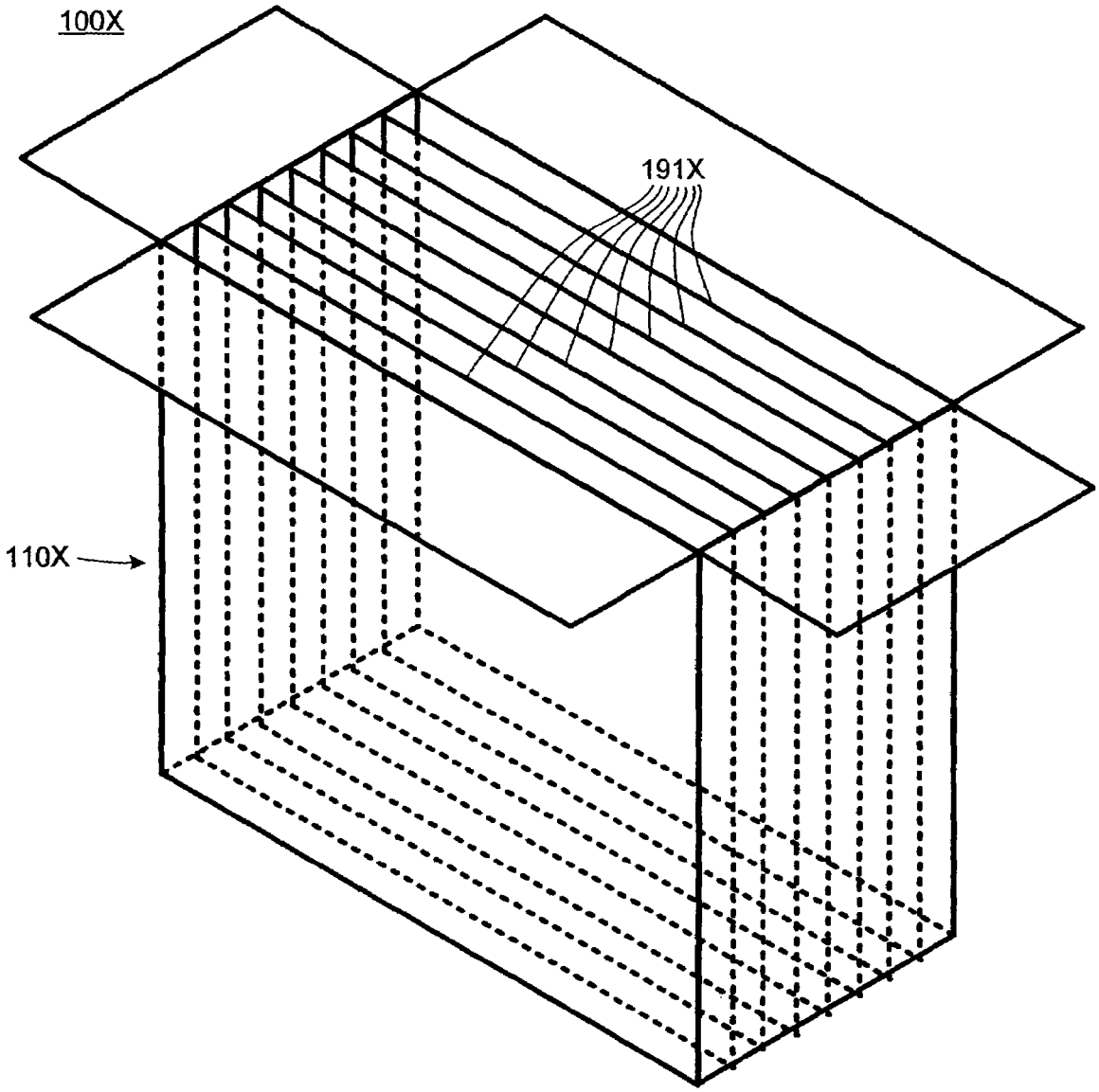
FIG. 8 is a perspective view showing a packing container 100X according to a comparative example 1 of the present invention.
Figure 9:
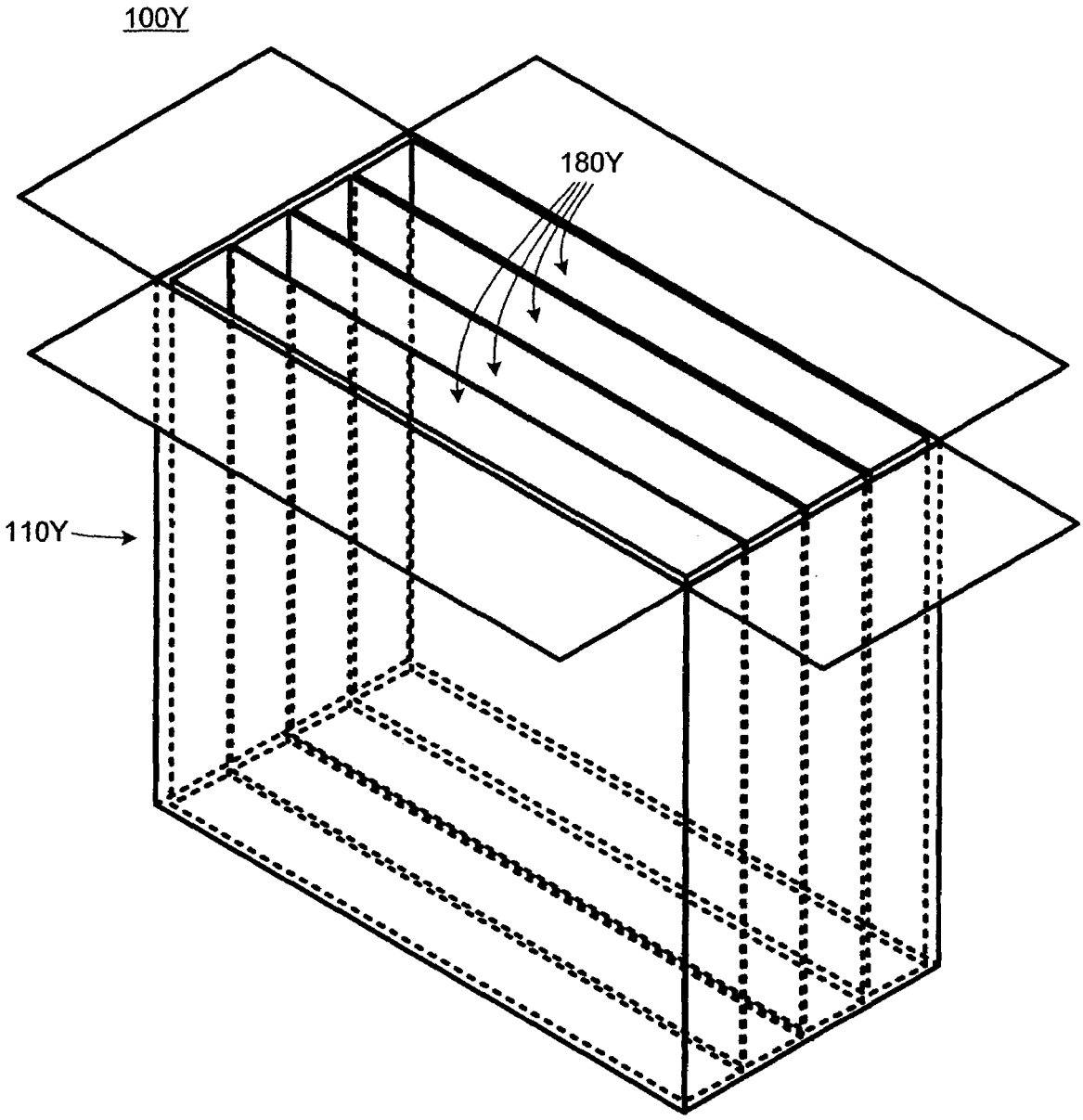
FIG. 9 is a perspective view showing a packing container 100Y according to a comparative example 2 of the present invention.

FIG. 8 and FIG. 9 are perspective views showing packing containers 100X, 100Y according to comparative examples 1, 2 of the present invention respectively. Partition plates 191X are disposed inside an outer case 110X of the packing container 100X.

The partition plate 191X is not fixed to the outer case 110X. Therefore, displacement of the partition plate 191X and a product in the outer case 110X cannot be restrained. In particular, in a case that the product is inserted into part of a space between the partition plates X, there is a possibility that the product is substantially displaced due to leaning of the packing container 100X, leading to damage of the product in transportation or the like.

Four partition members 180Y are disposed inside an outer case 110Y of the packing container 100Y. The partition members 180Y are disposed with being adhered to each other inside the outer case 110Y. Therefore, the partition member 180Y is prevented from being displaced inside the outer case 110Y.

In the packing container 100Y, the inside of the outer case 110Y is divided into four similarly to in the packing container 100. However, in comparison with the packing container 100, twice as many as the partition members 180Y are used in the packing container 100Y. Therefore, the packing container 100Y causes cost increase. Further, in consideration of a thickness of a side plate of the partition plate 180Y, an outer case 110Y larger than the outer case 110 is necessary in order to pack the same product.

In contrast, in the packing container 100 according to the embodiment of the present invention, a smaller number of the partition members 180 than in the packing container 100Y are used, and the partition members 180 can be easily fixed to the outer case 110. More specifically, the packing container 100 has the following advantages of (1) and (2).

(1) The number of the partition members 180 can be decreased. As a result, the packing container 100 can be made smaller, lighter, and lower-priced.

(2) The inside of the outer case 110 can be divided by inserting the partition member 180 into the outer case 110 and holding the partition member 180, so that displacement of products in the packing container 100 can be restrained. As a result, damage on the product in transportation or the like can be prevented. Further, it is possible not to fill the products in all divisions in the outer case 110.

(Assembling procedure of Packing Container 100)

Figure 10:
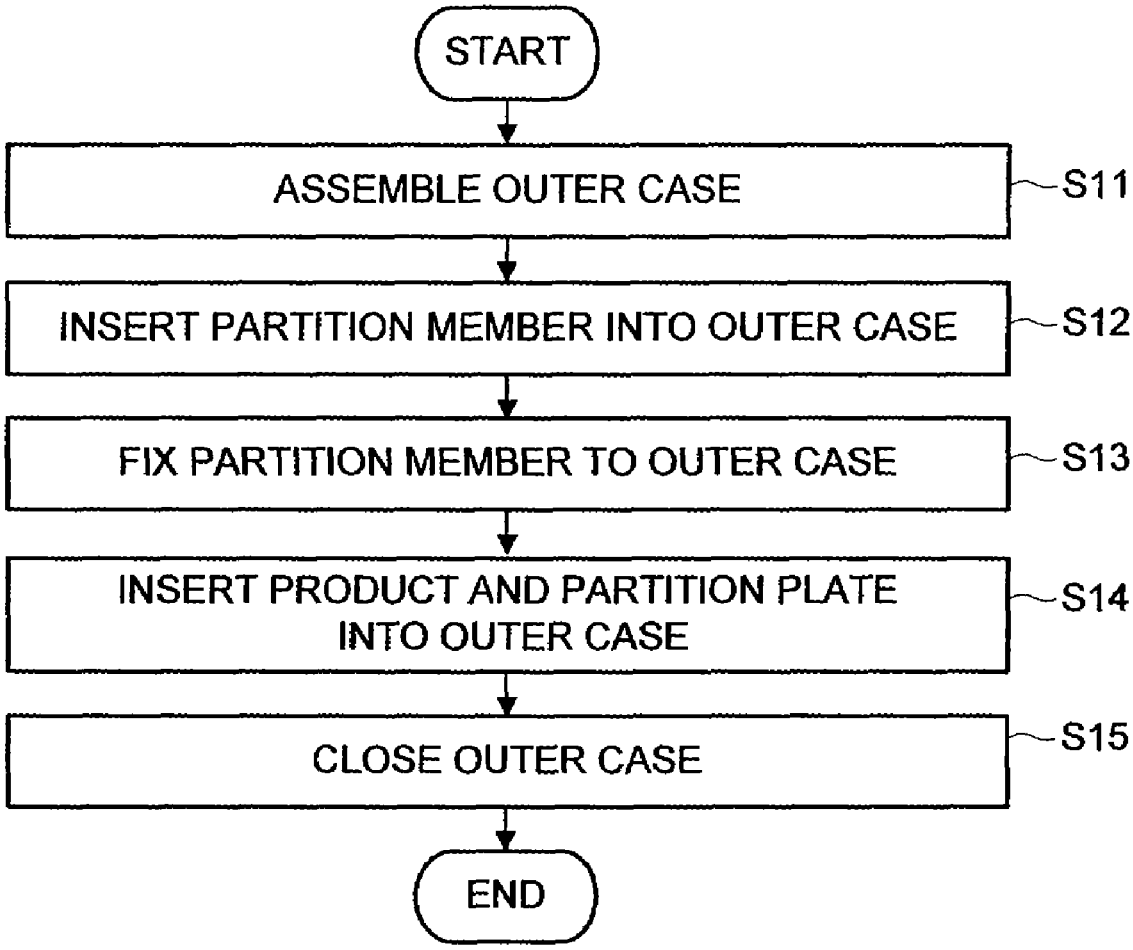
FIG. 10 is a flowchart showing an example of an assembling procedure of a packing container 100.

Hereinafter, an assembling procedure of a packing container 100 will be described. FIG. 10 is a flowchart showing an example of the assembling procedure of the packing container 100. FIG. 11A to FIG. 11F are perspective views showing states of the packing container 100 in this assembling procedure.

(1) Assembling of Outer Case 110 (Step S11)

Figure 11A:
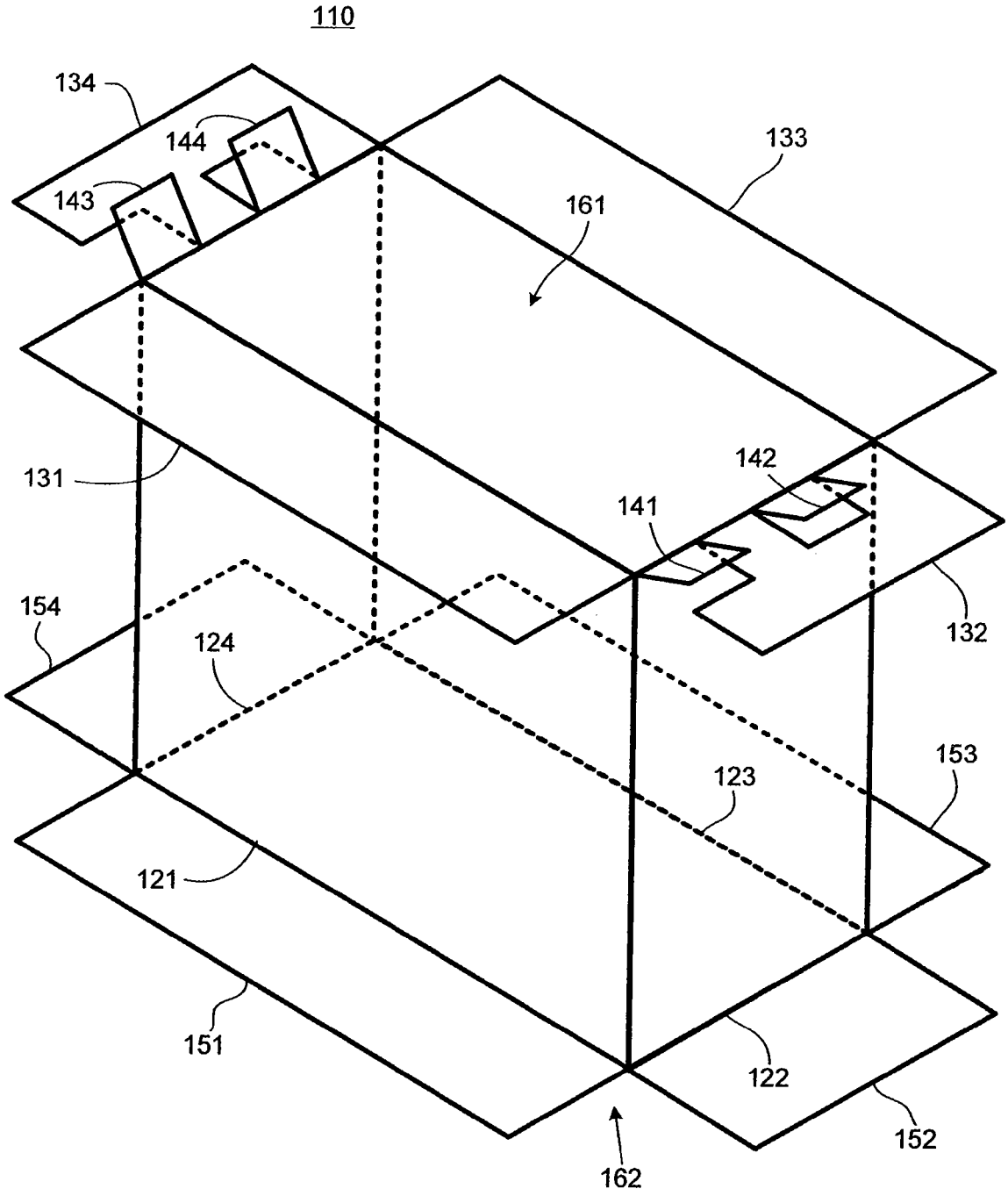
FIG. 11A is a perspective view showing an example of a state of the packing container 100 in the assembling procedure
Figure 11B:
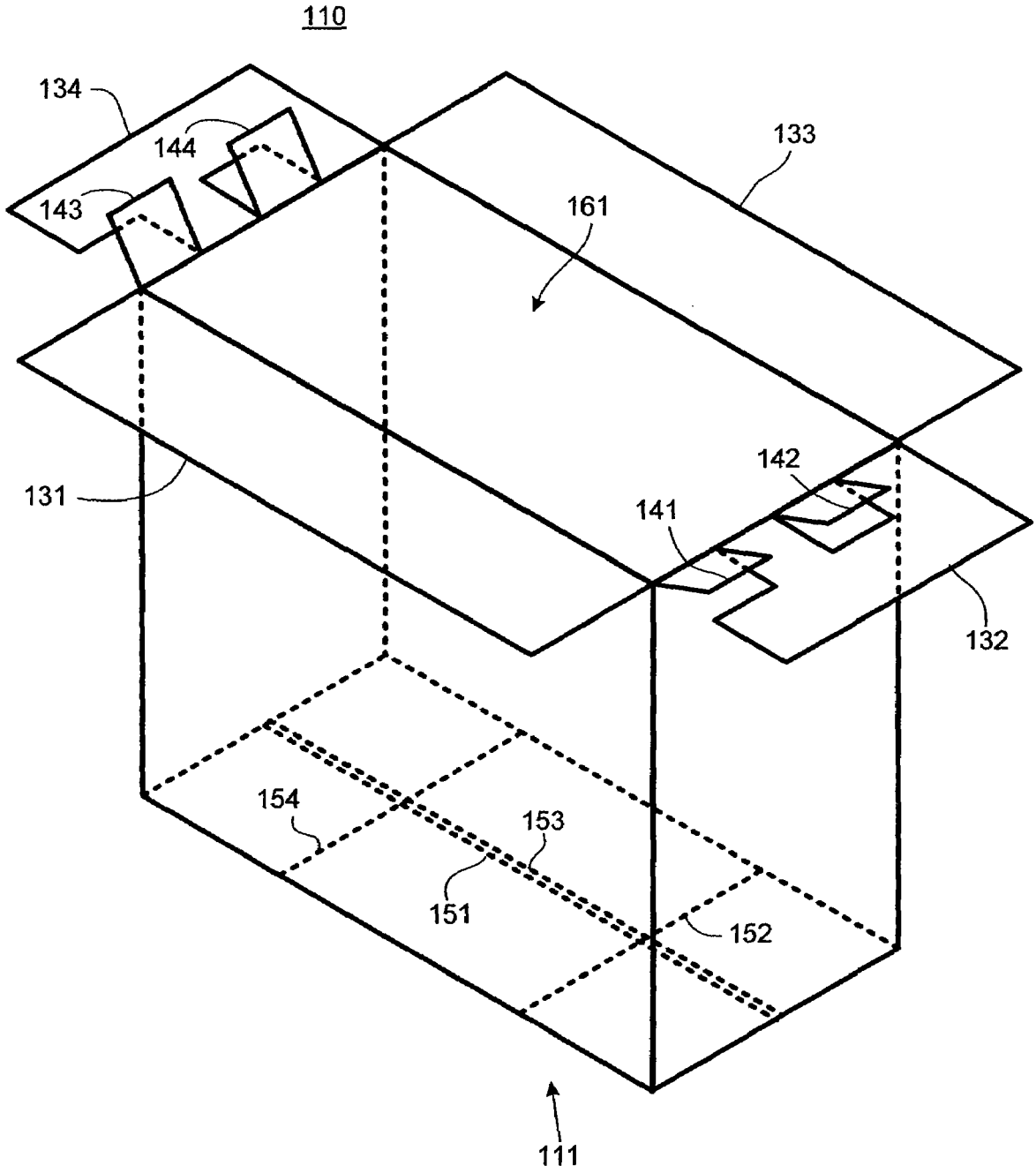
FIG. 11B is a perspective view showing an example of a state of the packing container 100 in the assembling procedure.

An outer case 110 is assembled. FIG. 11A and FIG. 11B are perspective views showing the outer case 110 before/after assembling respectively. By closing bottom cover plates 151 to 154 of the outer case 110, a bottom plate 111 is formed.

(2) Inserting of Partition Member 180 into Outer Case 110, Fixing (Steps S12, S13)

Figure 11C:
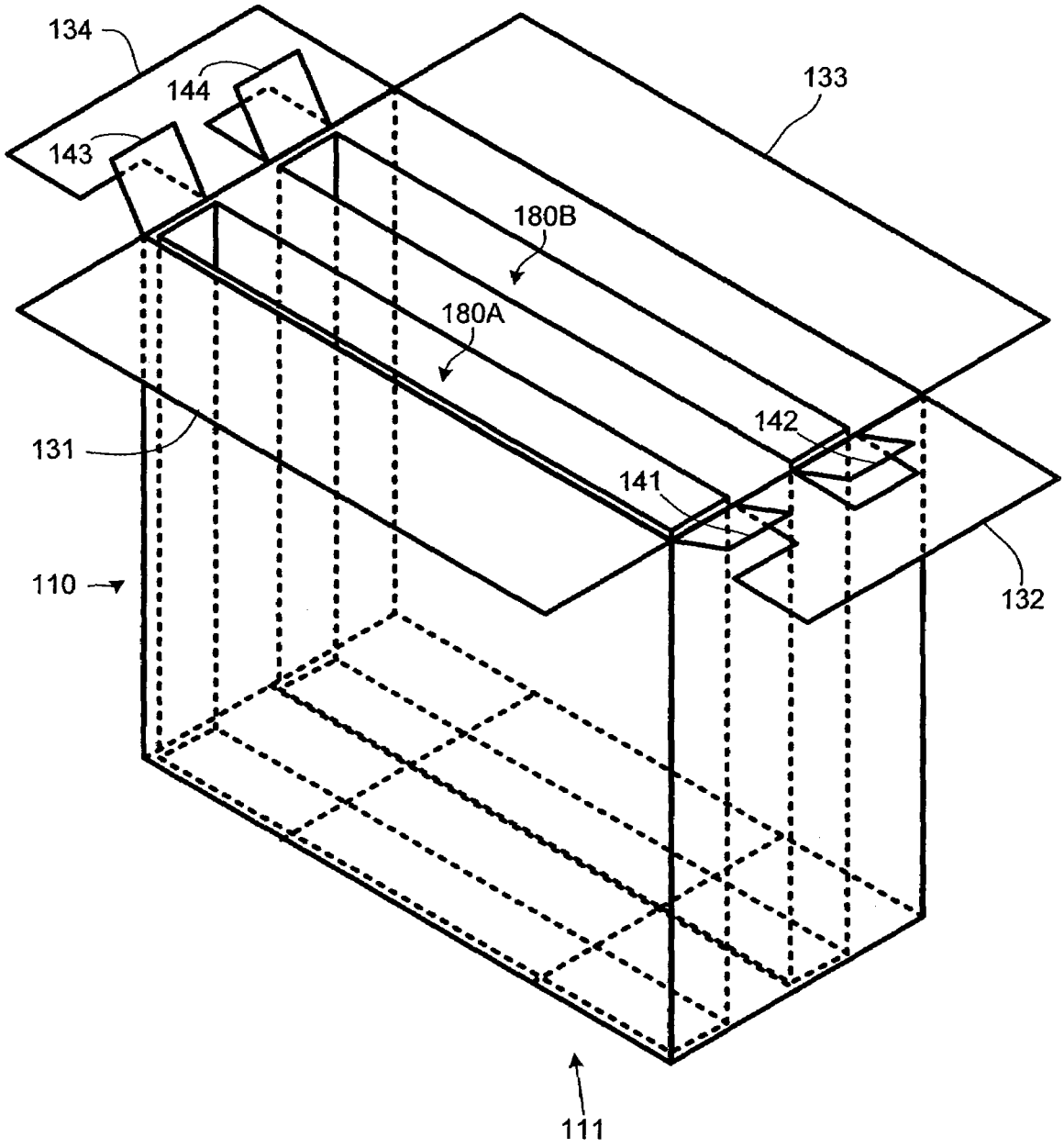
FIG. 11C is a perspective view showing an example of a state of the packing container 100 in the assembling procedure.
Figure 11D:
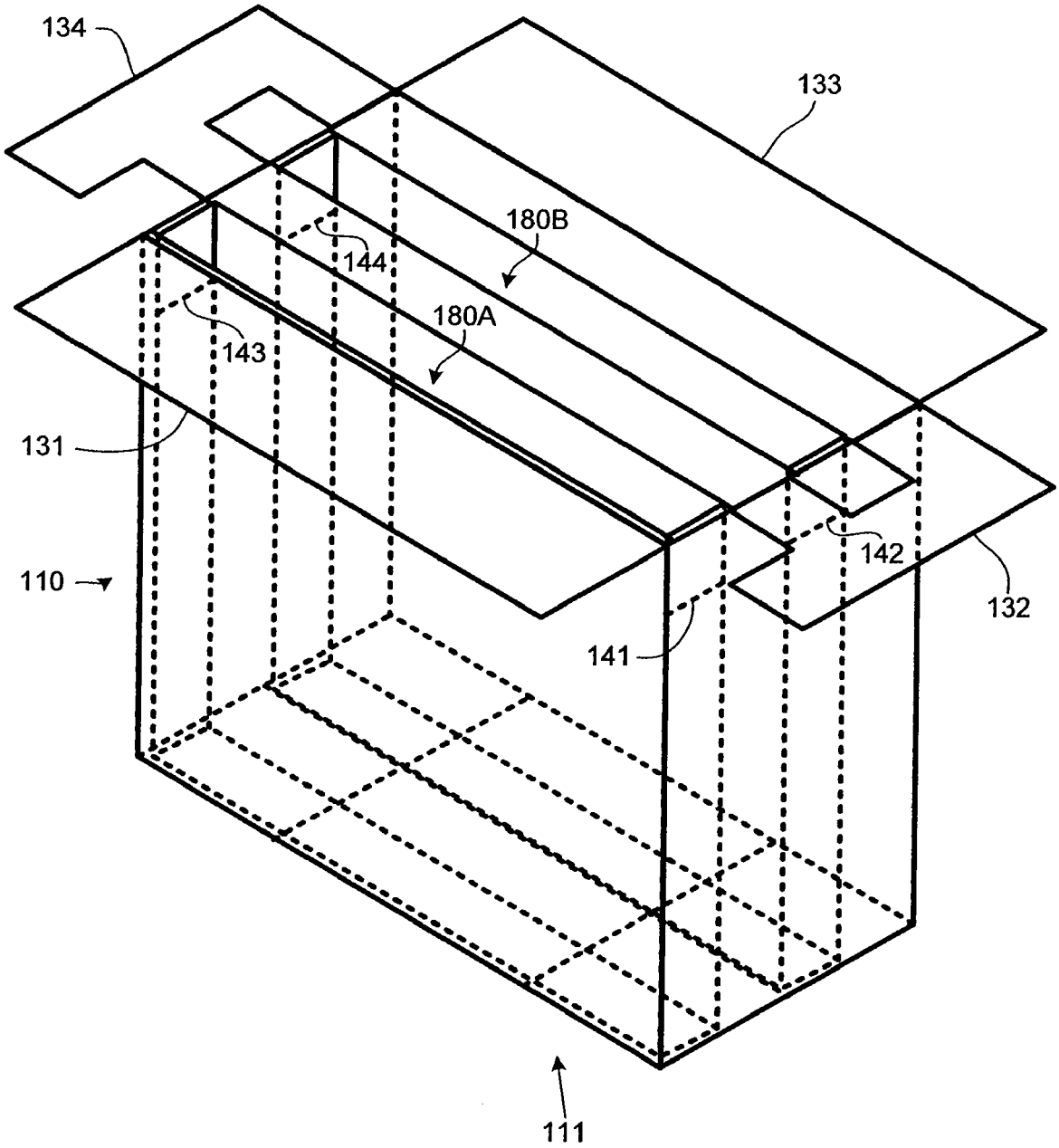
FIG. 11D is a perspective view showing an example of a state of the packing container 100 in the assembling procedure.

Partition members 180A, 180B are inserted into the outer case 110 and fixed thereto. FIG. 11C and FIG. 11D are perspective views showing a state that the partition members 180A, 180B are inserted into the outer case 110 and a state that the partition members 180A, 180B are fixed thereafter, respectively. Holding plates 141 to 144 are inserted into the inside of the partition members 180A, 180B which have been inserted into the outer case 110, whereby the partition members 180A, 180B are fixed to the outer case 110. As is already described, in order to intensify fixing of the partition members 180A, 180B and the outer case 110, it can be considered, for example, to insert end portions of the holding plates 141 to 144 into slits H of side plates 182, 184 of the partition members 180A, 180B. Thereby, the inside of the outer case 110 is divided into four.

(3) Inserting of Product P and Partition Plate 191 into Outer Case 110 (Step S14)

Two products P and a partition plate 191 to be disposed between those products P are inserted into each of four divisions of the outer case 110.

(4) Closing of Outer Case 110 (Step S15)

Figure 11E:
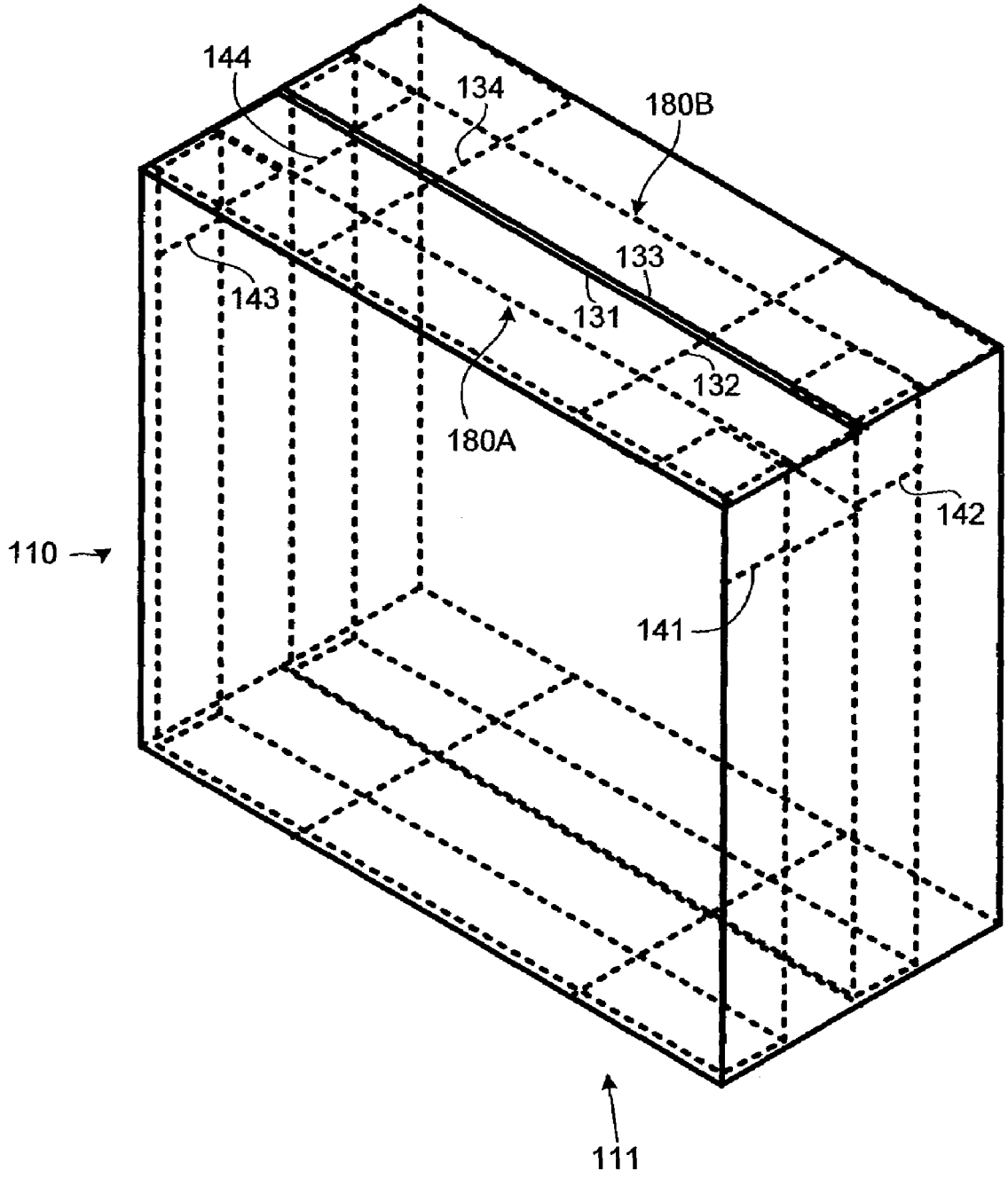
FIG. 11E is a perspective view showing an example of a state of the packing container 100 in the assembling procedure.

The outer case 110 is closed. In other words, upper cover plates 131 to 134 of the outer case 110 are closed, whereby an upper plate is formed. FIG. 11E is a perspective view showing a state that the outer case 110 is closed. The products P and the partition plate 191 are omitted to be illustrated, for the sake of comprehensibility.

Second Embodiment

Figure 12:
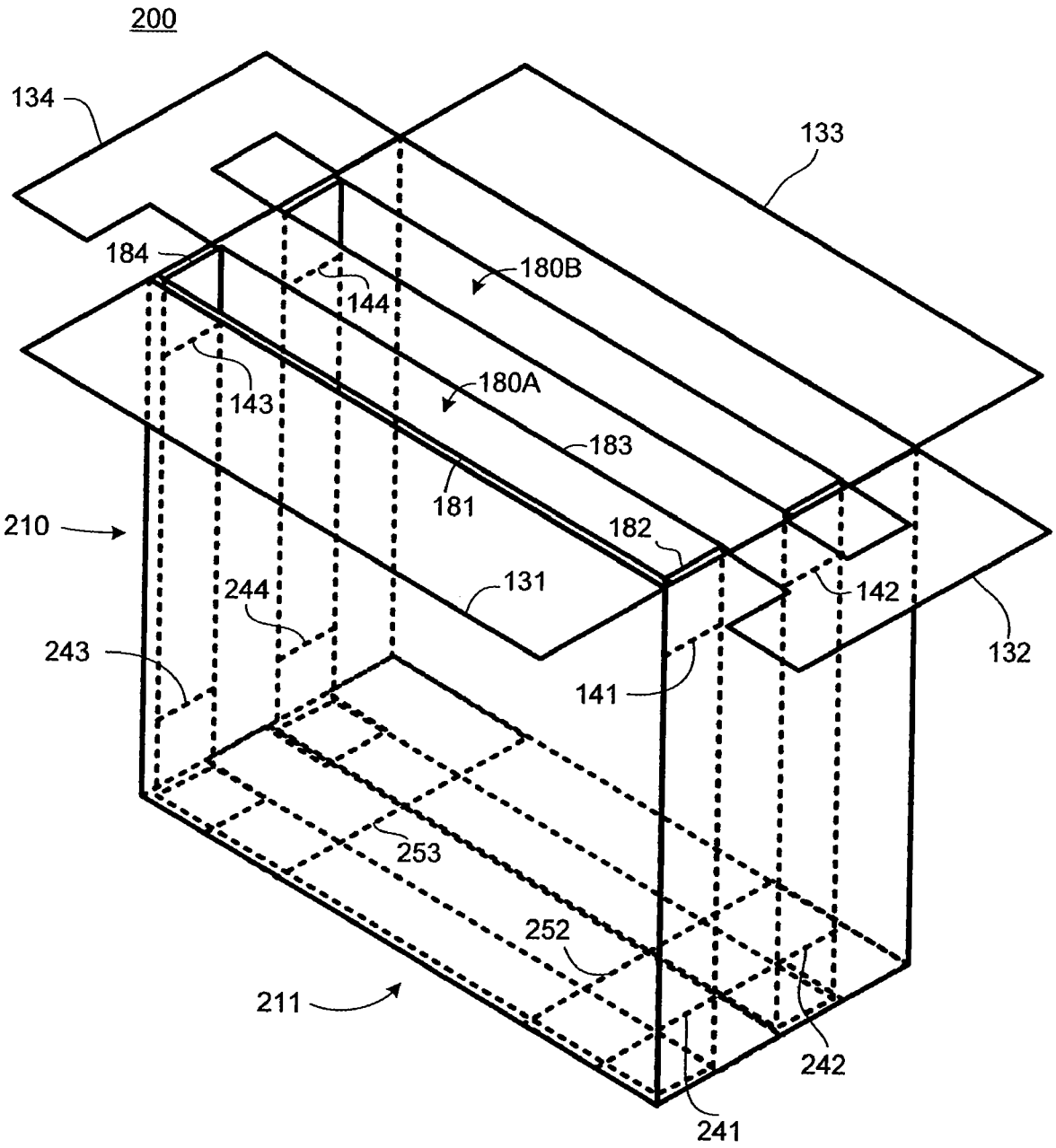
FIG. 12 is a perspective view showing a packing container 200 according to a second embodiment of the present invention.
Figure 13:
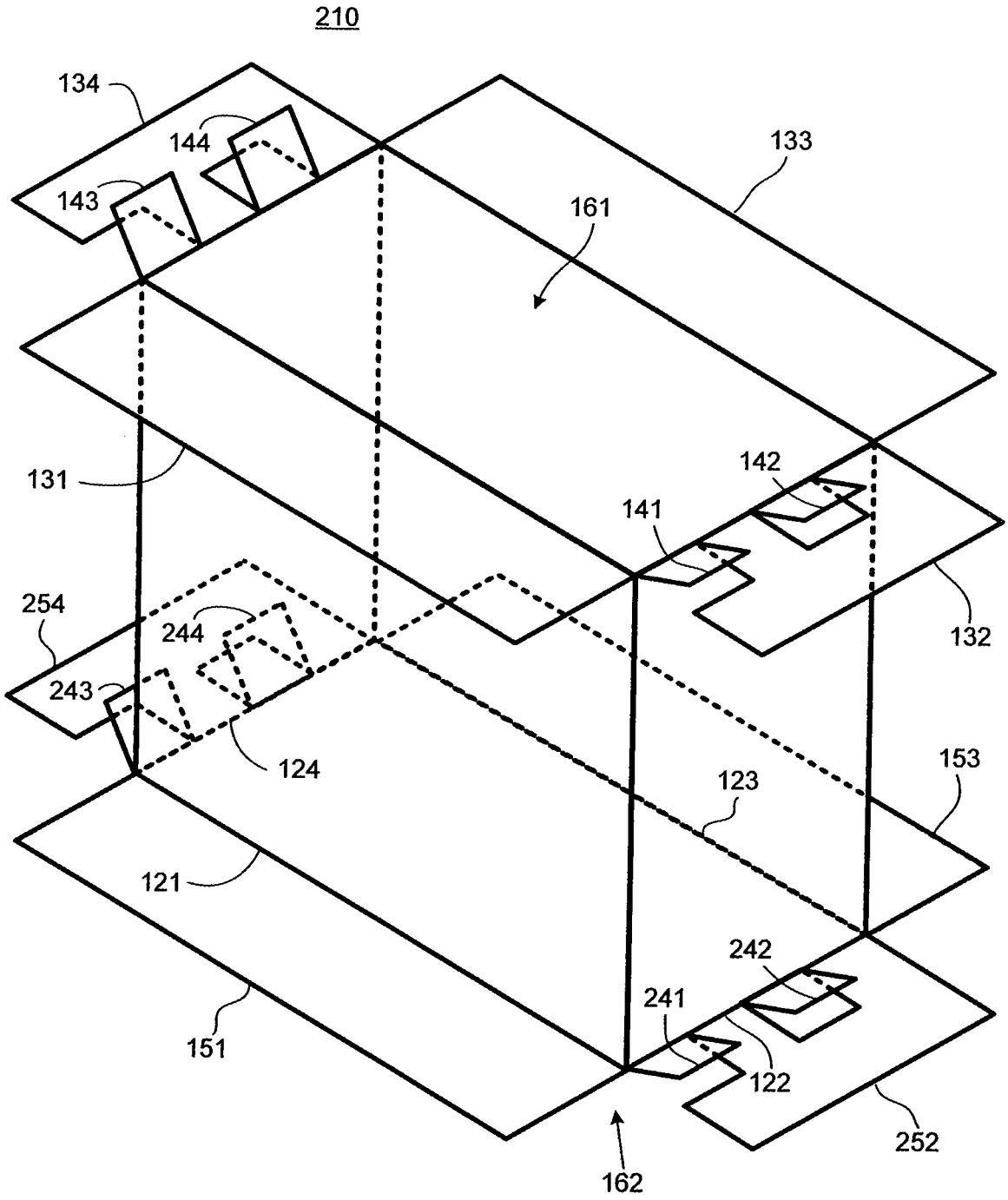
FIG. 13 is a perspective view showing an outer case 210 in a developed state.

A second embodiment of the present invention will be described. FIG. 12 is a perspective view showing a packing container 200 according to the second embodiment of the present invention. The packing container 200 includes an outer case 210 and a partition member 180 (180A, 180B). FIG. 13 is a perspective view showing the outer case 210. The outer case 210 is structured by, for example, paper such as corrugated cardboard, and has a bottom plate 211, side plates 121 to 124, upper cover plates 131 to 134, and holding plates 141 to 144, 241 to 244. The bottom plate 211 is constituted with bottom cover plates 151, 252, 153, 254.

The holding plates 241 to 244 are disposed on lower edges of the side plates 122, 124, symmetrically to the holding plates 141 to 144. These holding plates 241 to 244 can be formed by cutting out the bottom cover plates 252, 254. The holding plates 241 to 244 prevent displacement in lower portions of the partition members 180A, 180B more surely. In other words, by holding upper and lower sides of the partition member 180 by the holding plates 141 to 144, 241 to 244, reliability of fixing the partition member 180 is further improved.

Here, it is preferable that side plates 182, 184 of the partition member 180 and the holding plates 241 to 244 are secured. For example, the side plates 182, 184 and the holding plates 241 to 244 can be secured by adhesive tapes. It is also possible to make slits in the side plates 182, 184, into which end portions of the holding plates 241 to 244 are inserted, so that the side plates 182, 184 and the holding plates 241 to 244 can be secured. In such a case, it is preferable that the end portions of the holding plates 241 to 244 have taper shapes (for example, triangular shapes, trapezoid shapes).

Third Embodiment

Figure 14:
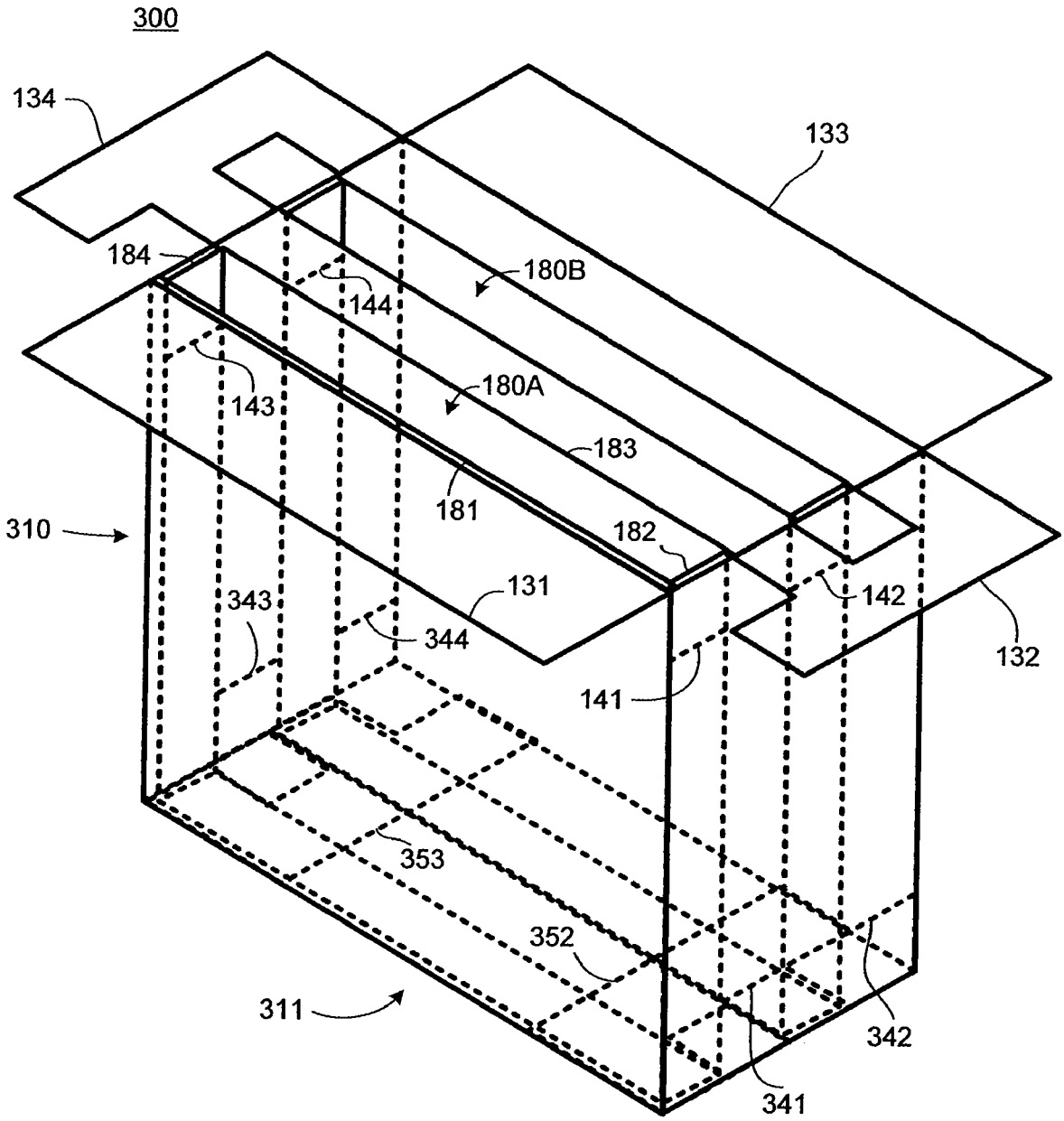
FIG. 14 is a perspective view showing a packing container 300 according to a third embodiment of the present invention.
Figure 15:
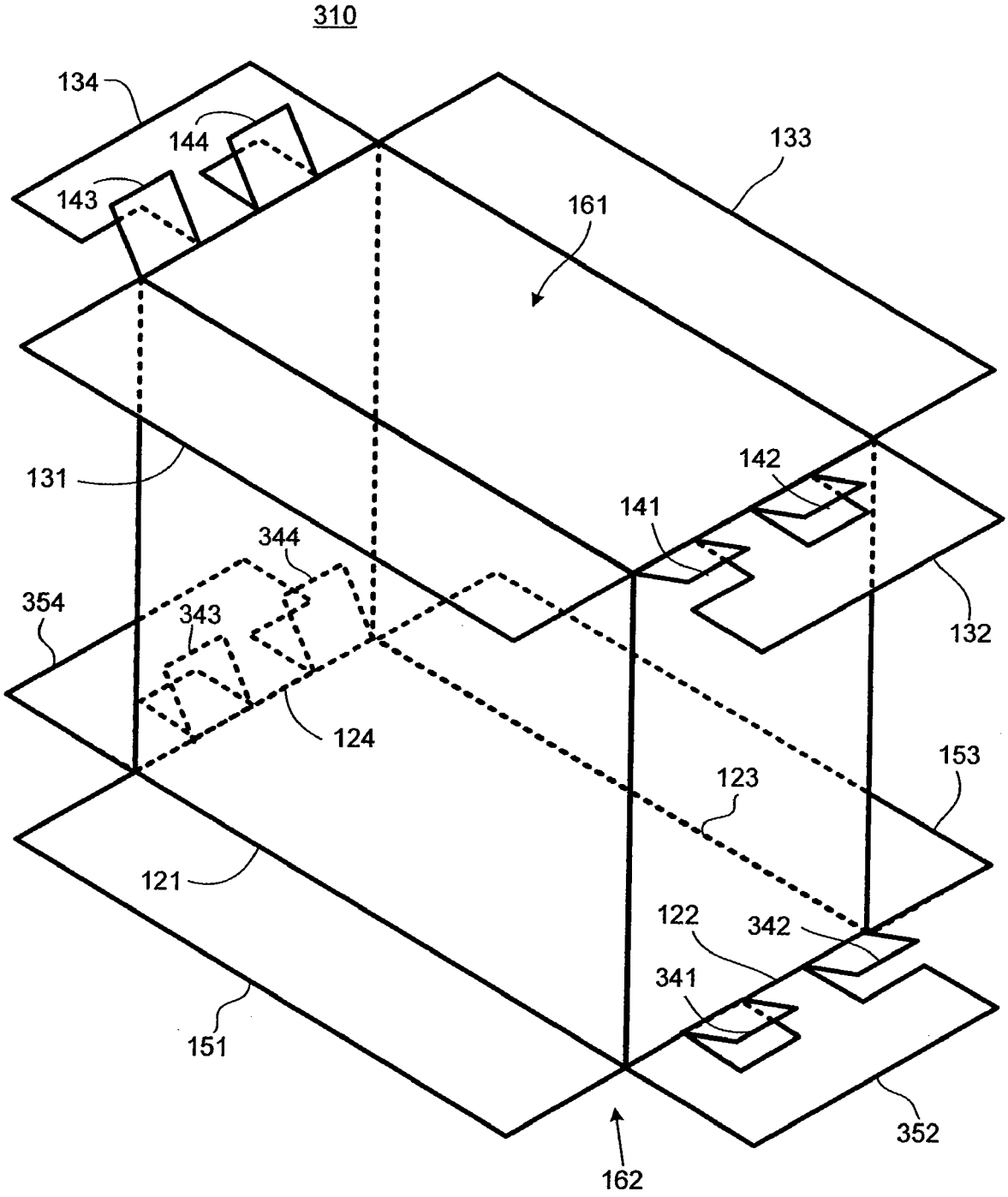
FIG. 15 is a perspective view showing an outer case 310 in a developed state.

A third embodiment of the present invention will be described. FIG. 14 is a perspective view showing a packing container 300 according to the third embodiment of the present invention. The packing container 300 includes an outer case 310 and a partition member 180 (180A, 180B). FIG. 15 is the perspective view showing the outer case 310. The outer case 310 is structured by, for example, paper such as corrugated cardboard, and has a bottom plate 311, side plates 121 to 124, upper cover plates 131 to 134, and holding plates 141 to 144, 341 to 344. The bottom plate 311 is constituted with bottom cover plates 151, 352, 153, 354.

The holding plates 341 to 344 are disposed on lower edges of the side plates 122, 124, asymmetrically to the holding plates 141 to 144. These holding plates 341 to 344 can be formed by cutting out the bottom cover plates 352, 354. The holding plates 341 to 344 are disposed outside the partition member 180, not inside the partition member 180. As described above, a lower portion of the partition member 180 can be also fixed by disposing the holding plates 341 to 344 outside the partition member 180 instead of inside the partition member 180.

Here, it is preferable that side plates 181, 183 of the partition member 180 and the holding plates 341 to 344 are secured. For example, the side plates 181, 183 and the holding plates 341 to 344 can be secured by adhesive tapes. It is also possible to make slits in the side plates 181, 183 and side portions of the holding plates 341 to 344 have projecting shapes corresponding to those slits. By inserting projections of the side portions of the holding plates 341 to 344 into the slits of the side plates 181, 183, the side plates 181, 183 and the holding plates 341 to 344 can be secured. In such a case, it is preferable that the projections have taper shapes (for example, triangular shapes, trapezoid shapes).

Other Embodiment

Embodiments of the present invention are not limited to the above-described embodiments, and the embodiments can be expanded or modified. These expanded and modified embodiments are also included in the technical scope of the present invention. For example, it is also possible to dispose the holding plates 141 to 144, 241 to 244 in the packing containers 100, 200 outside the partition members 180, according as the packing container 300. In other words, disposing of the holding plates 141 to 144, 241 to 244, 341 to 344 inside the partition member 180 or outside the partition member 180 can be properly combined.

What is claimed is:

1. A packing container, comprising:

an outer case including: an almost rectangular bottom plate; first to fourth side plates sequentially disposed in correspondence with edges of the bottom plate respectively; a first opening of an almost rectangular shape facing the bottom plate; and first and second top plates connected with each upper edge of the first and third side plates respectively;

a first partition member disposed inside the outer case and apart from the second side plate, the first partition member including: fifth and sixth side plates disposed in close vicinity to or in contact with the first and third side plates respectively; seventh and eighth side plates at least one of which divides the inside of the outer case; and a second opening disposed in correspondence with the first opening;

a first holding plate connected to an upper edge of the first side plate and inserted into the inside of the outer case from the first opening, the first holding plate holding the first partition member;

a second holding plate connected to an upper edge of the third side plate and inserted into the inside of the outer case from the first opening, the second holding plate holding the first partition member, a second partition member disposed inside the outer case between the first partition member and the fourth side plate and apart from the first partition member, the second partition member including: ninth and tenth side plates disposed in close vicinity to or in contact with the first and third side plates respectively; eleventh and twelfth side plates at least one of which divides the inside of the outer case; and a third opening disposed in correspondence with the first opening;

a third holding plate connected to an upper edge of the first side plate and inserted into the inside of the outer case from the first opening, the third holding plate holding the second partition member; and a fourth holding plate connected to an upper edge of the third side plate and inserted into the inside of the outer case from the first opening, the fourth holding plate holding the second partition member, wherein the first and third holding plates are each formed from the first top plate by cutting out a part of the first top plate except where the first top plate connects to the upper edge of the first side plate, and the remaining part of the first top plate is integrally formed, wherein the second and fourth holding plates are each formed from the second top plate by cutting out a part of the second top plate except where the second top plate connects to the upper edge of the third side plate, and the remaining part of the second top plate is integrally formed, and wherein the inside of the outer case is divided into a first room between the second side plate and the first partition member, a second room inside the first partition member, a third room between the first and second partition members, and a fourth room inside the second partition member.

2. The packing container according to claim 1, wherein at least one of the first to fourth holding plates is inserted into the inside of the first or second partition member from the second or third opening.

3. The packing container according to claim 1, wherein at least one of the first to fourth holding plates is disposed in one of the second and fourth rooms.

4. The packing container according to claim 1, wherein at least one of the fifth, sixth, ninth, and tenth side plates includes a slit into which an end of a respective one of the first to fourth holding plates is inserted.

5. The packing container according to claim 1, wherein the outer case, the first and second partition members, and the first to fourth holding plates are made of corrugated cardboard.

6. The packing container according to claim 1, wherein the fourth side plate and the second partition member are spaced apart, and wherein the inside of the outer case is divided into the first room between the second side plate and the first partition member, the second room inside the first partition member, the third room between the first and second partition members, the fourth room inside the second partition member, and a fifth room between the second partition member and the fourth side plate.

7. The packing container according to claim 1, further comprising:

a fifth holding plate connected to a lower edge of the first side plate and disposed inside the outer case, the fifth holding plate holding the first partition member; and a sixth holding plate connected to a lower edge of the third side plate and disposed inside the outer case, the sixth holding plate holding the first partition member, a seventh holding plate connected to a lower edge of the first side plate and disposed inside the outer case, the seventh holding plate holding the second partition member; and an eighth holding plate connected to a lower edge of the third side plate and disposed inside the outer case, the eighth holding plate holding the second partition member, wherein the bottom plate includes first and second bottom plates connected to each lower edge of the first and third side plates respectively, wherein the fifth and seventh holding plates are each formed from the first bottom plate by cutting out a part of the first bottom plate except where the first bottom plate connects to the lower edge of the first side plate, and the remaining part of the first bottom plate is integrally formed, and wherein the sixth and eighth holding plates are each formed from the second bottom plate by cutting out a part of the second bottom plate except where the second bottom plate connects to the lower edge of the third side plate, and the remaining part of the second bottom plate is integrally formed.

8. The packing container according to claim 1, wherein the remaining part of the first top plate partially covers the second and third openings, and the remaining part of the second top plate partially covers the second and third openings.

9. An assembling method of a packing container, comprising:

inserting first and second partition members into the inside of an outer case; and holding the first partition member with first and second holding plates and holding the second partition member with third and fourth holding plates, wherein the outer case includes an almost rectangular bottom plate; first to fourth side plates sequentially disposed in correspondence with edges of the bottom plate respectively, a first opening of an almost rectangular shape facing the bottom plate; and first and second top plates connecting with each upper edge of the first and third side plates respectively;

the first partition member includes fifth to eighth side plates, and a second opening;

the second partition member includes ninth to twelfth side plates, and a third opening;

the first and second holding plates are connected to upper edges of the first and third side plates respectively;

the third and fourth holding plates are connected to upper edges of the first and third side plates respectively;

the first and third holding plates are each formed from the first top plate by cutting out a part of the first top plate except where the first top plate connects to the upper edge of the first side plate, and the remaining part of the first top plate is integrally formed;

the second and fourth holding plates are each formed from the second top plate by cutting out a part of the second top plate except where the second top plate connects to the upper edge of the third side plate, and the remaining part of the second top plate is integrally formed;

in the inserting, the second side plate and the first partition member are spaced apart, the fifth and sixth side plates are disposed in close vicinity to or in contact with the first and third side plates respectively, the first and second partition members are spaced apart, the ninth and tenth side plates are disposed in close vicinity to or in contact with the first and third side plates respectively, the second and third openings are disposed in correspondence with the first opening, the inside of the outer case is divided into a first room between the second side plate and the first partition member, a second room inside the first partition member, a third room between the first and second partition members, and a fourth room inside the second partition member; and in the holding, the first to fourth holding plates are inserted into the inside of the outer case from the first opening.

* * * * *